US012171327B2

(12) United States Patent
Fulks

(10) Patent No.: US 12,171,327 B2
(45) Date of Patent: Dec. 24, 2024

(54) DESK UTILITY SYSTEM AND METHOD OF USE

(71) Applicant: Jayson Emmet Fulks, Arlington, TX (US)

(72) Inventor: Jayson Emmet Fulks, Arlington, TX (US)

( * ) Notice: Subject to any disclaimer, the term of this patent is extended or adjusted under 35 U.S.C. 154(b) by 0 days.

(21) Appl. No.: 17/668,581

(22) Filed: Feb. 10, 2022

(65) Prior Publication Data

US 2023/0248140 A1 Aug. 10, 2023

(51) Int. Cl.
*A47B 21/04* (2006.01)

(52) U.S. Cl.
CPC ..... *A47B 21/04* (2013.01)

(58) Field of Classification Search
CPC ..... A47B 21/04; A47F 9/00; A47F 3/142
USPC ..... 108/28, 60, 61, 156, 64, 65; 144/286.1, 144/286.5; 312/140.4; 269/100; 403/363
See application file for complete search history.

(56) References Cited

U.S. PATENT DOCUMENTS 3,830,169 A * 8/1974 Madey ..... G09F 3/20 108/61
4,615,448 A * 10/1986 Johnstonbaugh ..... A47F 5/0846 D25/123
4,989,654 A * 2/1991 Berkeley ..... B25H 1/005 144/286.5
5,483,904 A * 1/1996 Kelly ..... A47B 13/08 108/158
5,848,497 A * 12/1998 Henderson ..... A47B 83/001 52/36.5
7,410,286 B2 * 8/2008 Travis ..... G02B 6/0046 362/616
10,507,571 B2 * 12/2019 Wang ..... B25H 1/08
2006/0157158 A1 * 7/2006 Freidlund ..... B27B 25/10 144/144.1
2008/0277025 A1 * 11/2008 Chang ..... B25H 1/14 144/287
2017/0173778 A1 * 6/2017 Reinhart ..... B25H 1/02

FOREIGN PATENT DOCUMENTS

CA 2831349 A1 * 10/2012 ..... E04F 13/08
GB 2148180 * 5/1985
GB 2331234 A * 5/1999 ..... A47B 13/021

* cited by examiner

*Primary Examiner* — Janet M Wilkens
(74) *Attorney, Agent, or Firm* — Novel Patent Services

(57) ABSTRACT

A desk comprising a utility system whereas extended channels are routed or carved into top, bottom and side surface areas of said desk to allow metal or plastic devices to snap or slide into said channels to hold and store various gadgets, smart phone, tablets, panels, backpacks, thus transforming a normal desk into a multi-purpose workstation that will greatly enhance the user experience.

4 Claims, 11 Drawing Sheets

DESK UTILITY SYSTEM AND METHOD OF USE

1. FIELD OF THE INVENTION

The present invention relates generally to desks, and more specifically to a desk utility system.

2. DESCRIPTION OF RELATED ART

Desks are well known in the art and are effective means of providing a flat table-style work surface. Desks are used in schools, offices, and homes and come in a variety of shapes and sizes.

Metal extrusions are well known in the art.

DETAILED DESCRIPTION OF THE INVENTION

Figure 1:
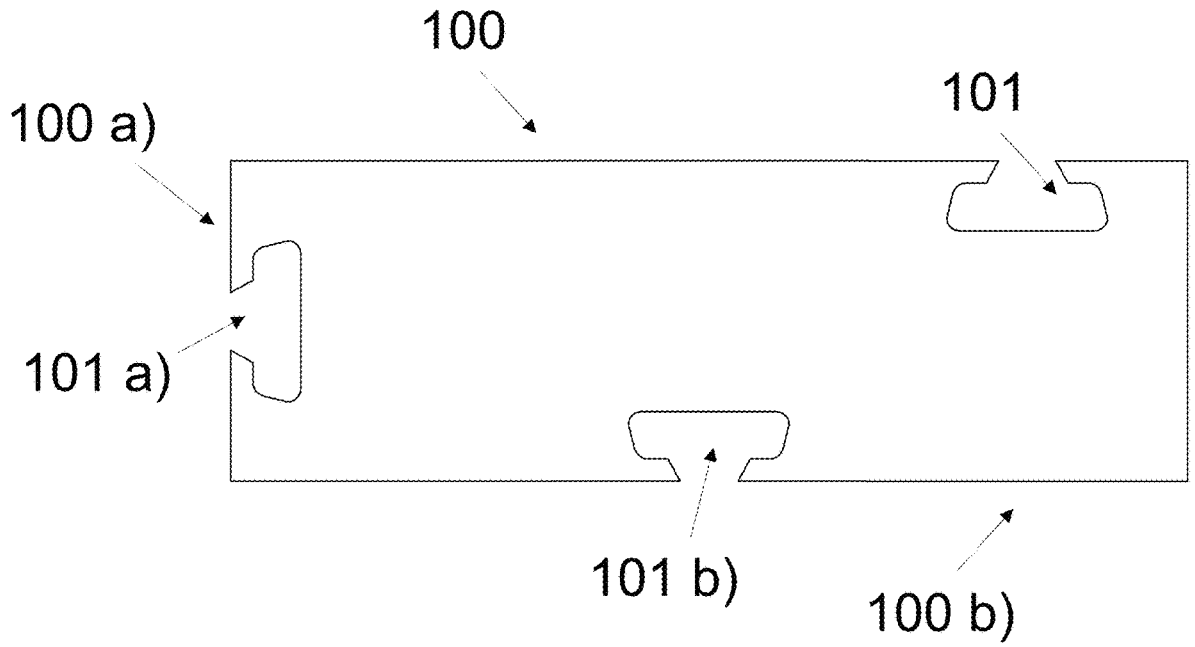
FIG. 1 illustrates a desk top surface having a desk side edge surface, and a desk bottom surface and an entrenched channel routed or carved into a desktop, a side edge surface, and bottom surfaces.
Figure 2:
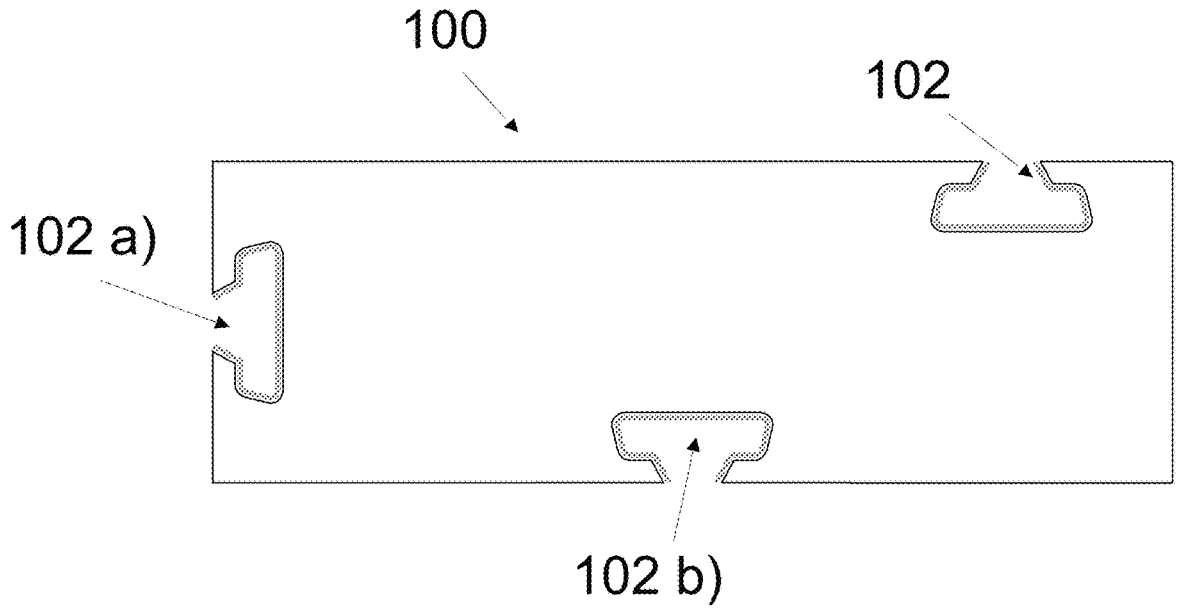
FIG. 2 illustrates extended extrusion that fit the design and slidingly inserted into the entrenched channel.
Figure 3:
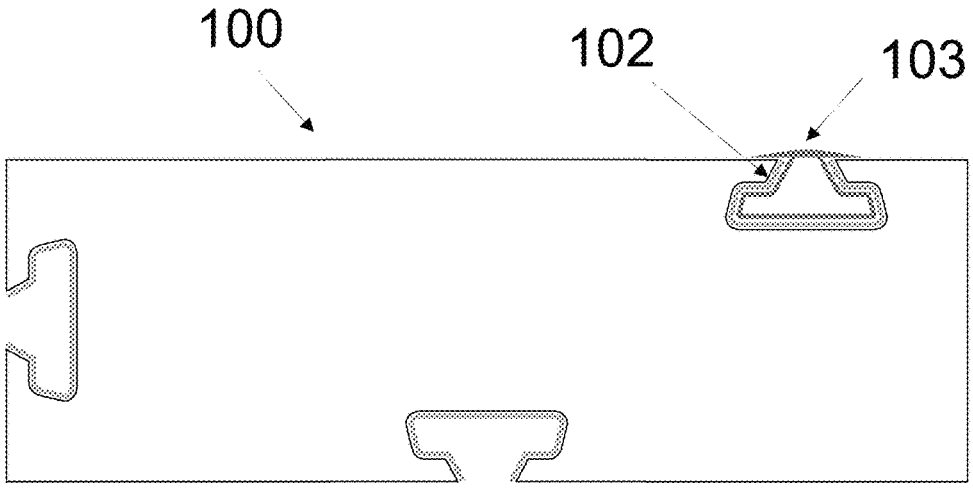
FIG. 3 illustrates utility device that slidingly fits the design of the extended extrusion and protects extended extrusion from dust, dirt, and particles.
Figure 4:
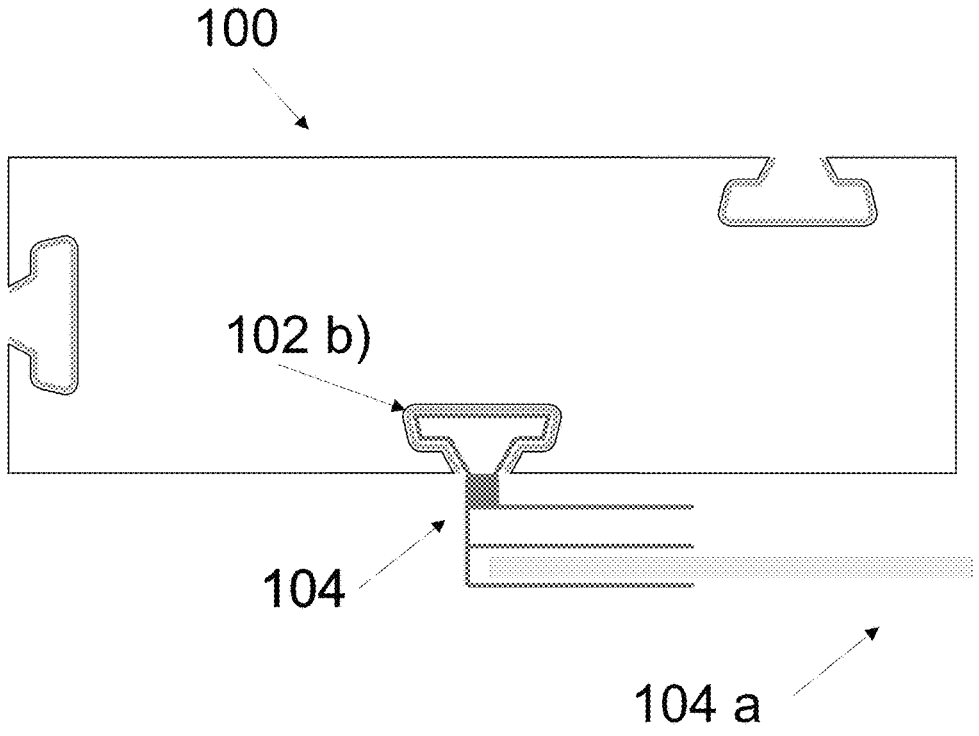
FIG. 4 illustrates utility device fitting said extended extrusion at the bottom surface of said desk to store panels.
Figure 5:
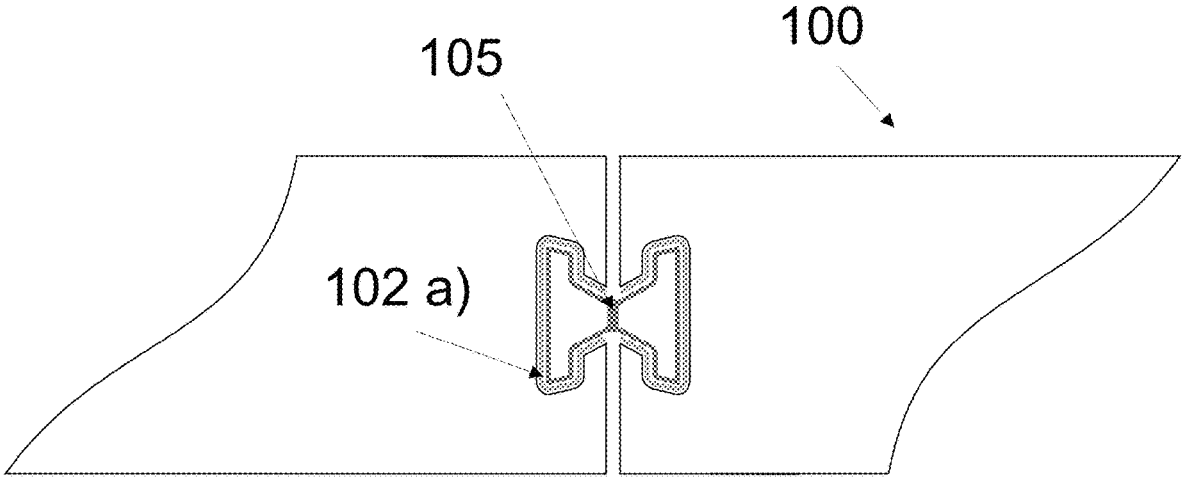
FIG. 5 illustrates utility device that slidingly fits the design of said extrusion on said side edge surface of said desktop.
Figure 6:
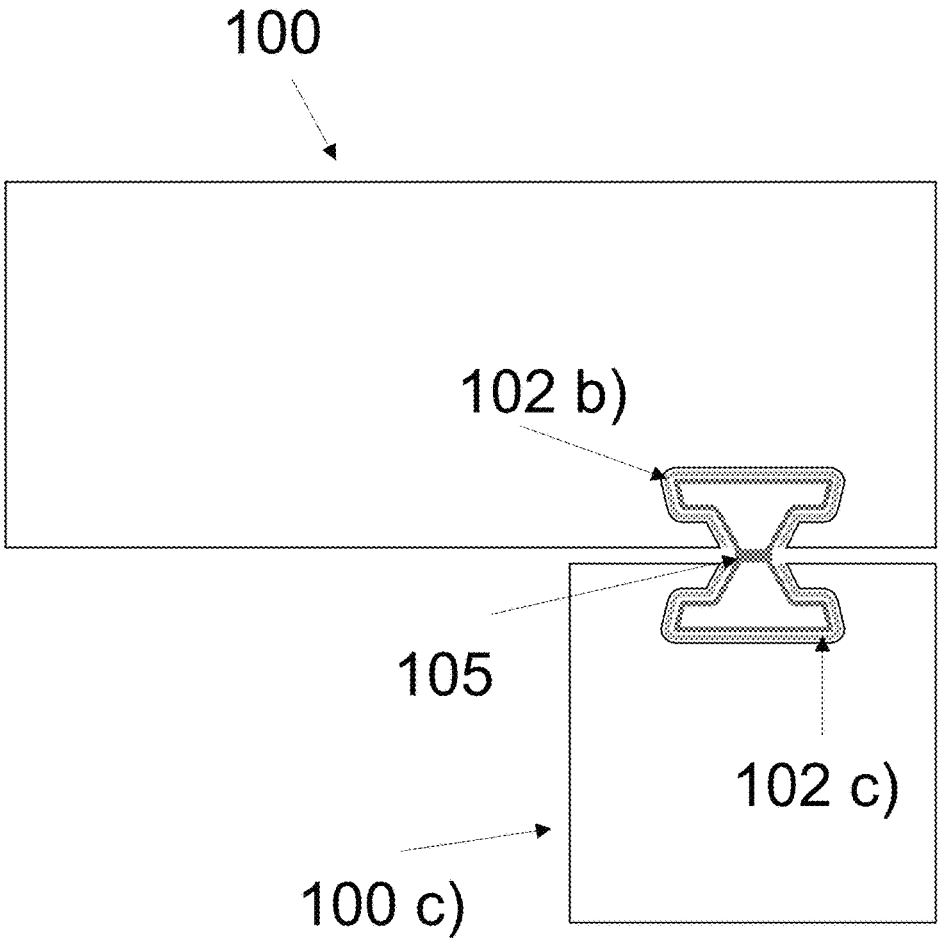
FIG. 6 illustrates said utility device fitting said extrusion to join and secure and hold in place said desk top surface and said leg unit.
Figure 7:
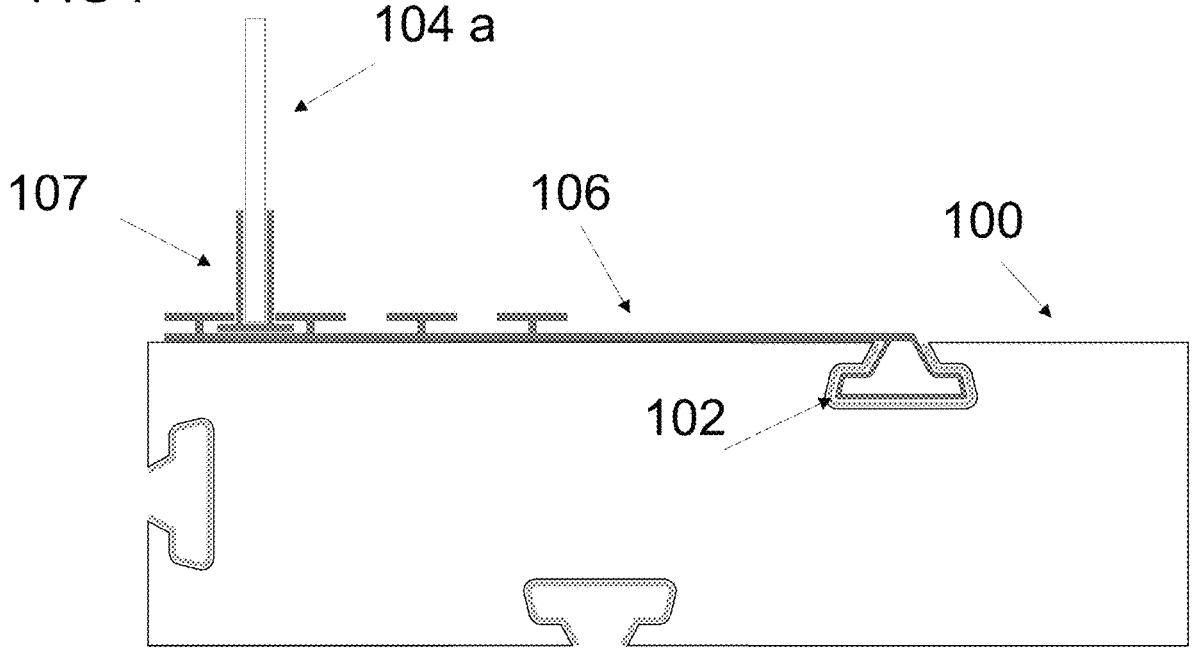
FIG. 7 illustrates a device that slidingly fits said extrusion 102 for creating channel for a device.
Figure 8:
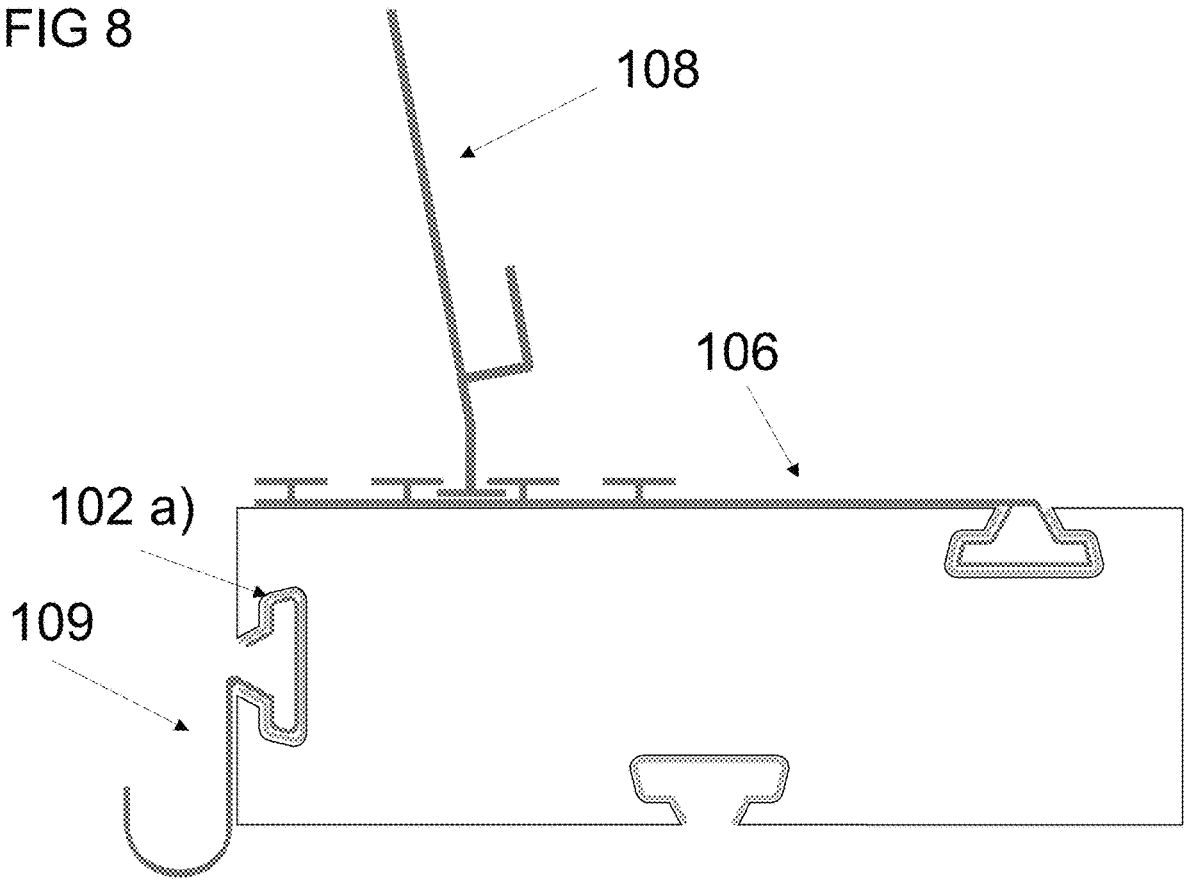
FIG. 8 illustrates an additional device that slidingly fits said devices.
Figure 9:
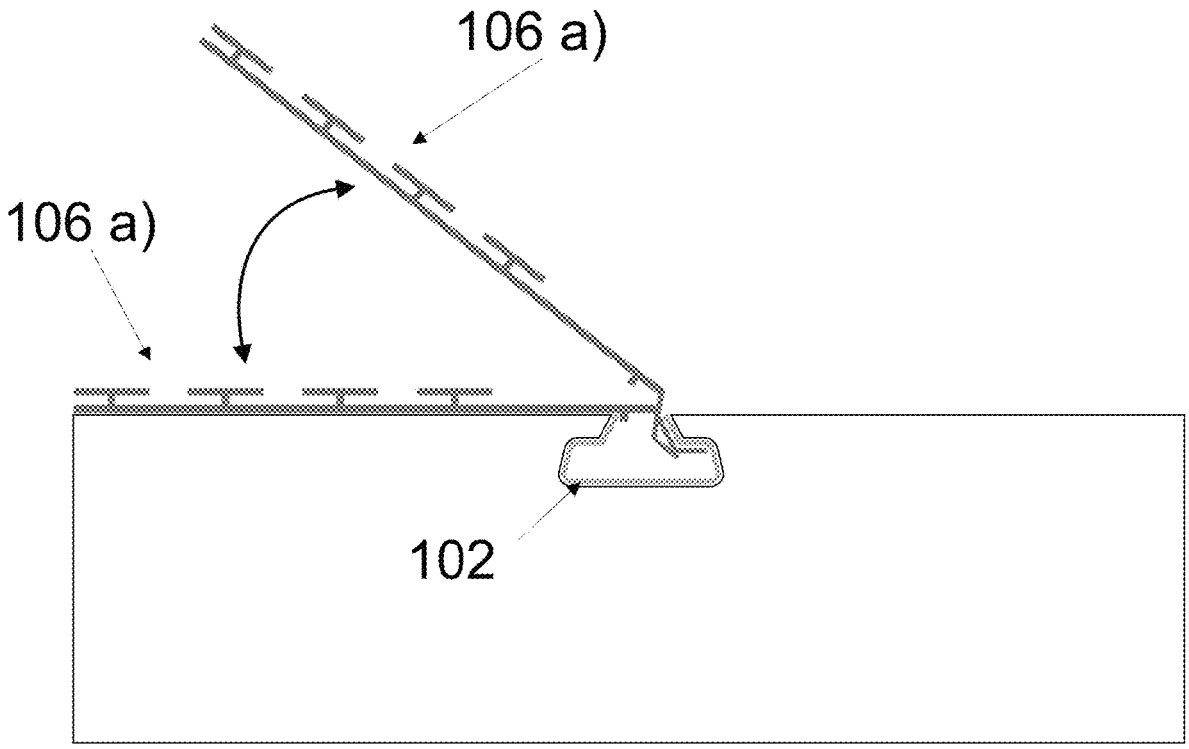
FIG. 9 illustrates a device mounted by way of snapping into at least one extended extrusion.
Figure 10:
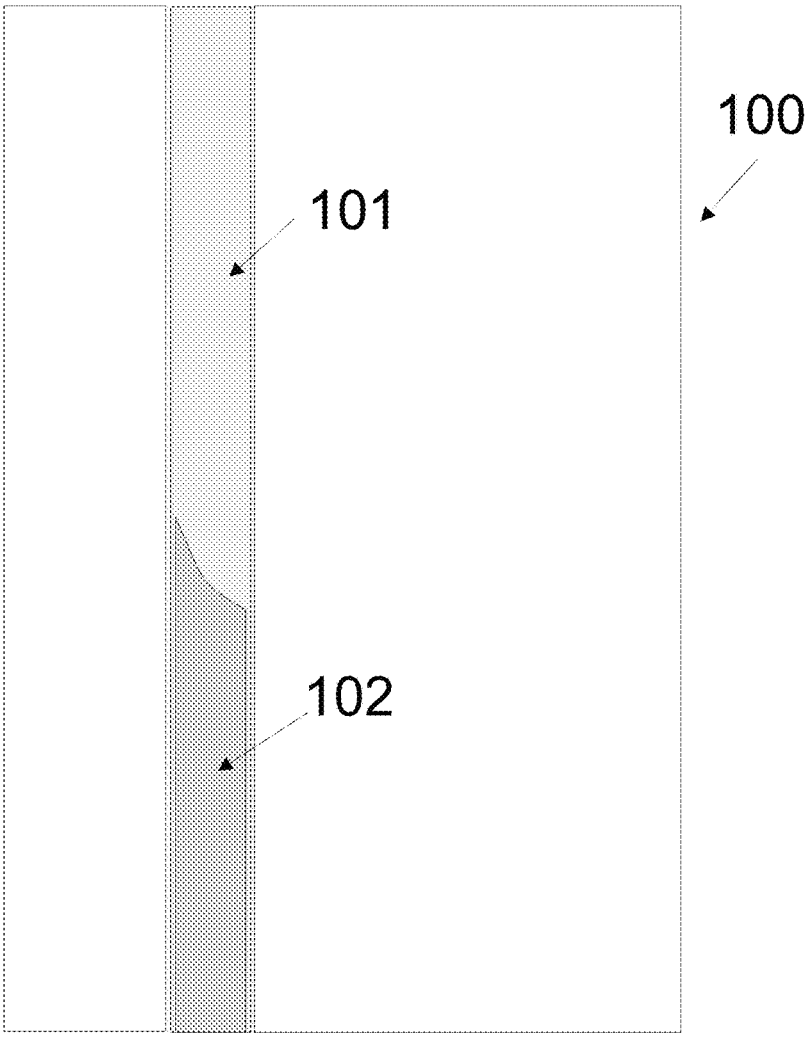
FIG. 10 illustrates top view of said entrenched channel on a desk top surface and said at least one extended extrusion.
Figure 11:
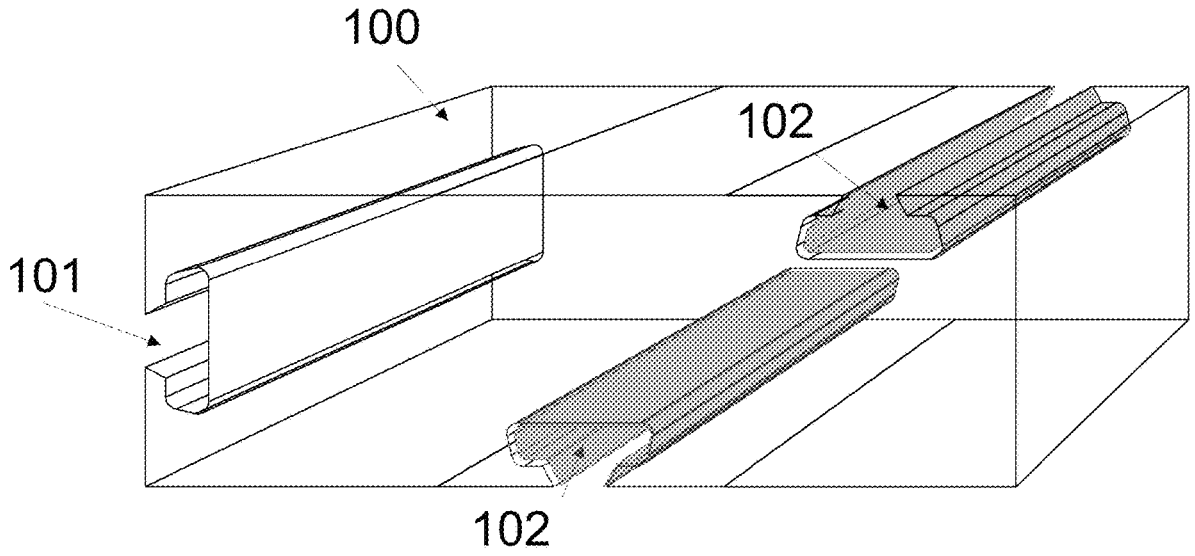
FIG. 11 illustrates perspective top view of said desktop, said entrenched channel and said extended extrusion.

FIG. 1 illustrates a desk top surface 100—desk side edge surface 100 a) and desk bottom surface 100 b)—and entrenched channel 101, 101 a), and 101 b) are routed or carved into the desktop, side edge surface, and bottom surfaces. FIG. 2 illustrates extended extrusion 102, 102 a) and 102 b) that fit the design and slidingly inserted into the entrenched channel 101, 101 a) and 101 b) to support said entrenched channel and to be used for utility device insert. FIG. 3 illustrates utility device 103 that slidingly fits the design of the extended extrusion 102 and protects the extended extrusion 102 from dust, dirt, and particles. FIG. 4 illustrates utility device 104 fitting said extended extrusion 102 b) at the bottom surface of said desk to store panels 104 a). FIG. 5 illustrates utility device 105 that slidingly fits the design of said extrusion 102 a) on said side edge surface of said desktop that joins and holds in place two or more said desks side by side when needed for creating larger desk of surface areas. FIG. 6 illustrates said utility device 105 fitting said extrusion 102 b) and 102 c) thus joins secures and holds in place said desk top surface 100, and said leg unit 100 c). FIG. 7 illustrates device 106 that slidingly fits said extrusion 102 thus creating channel for device 107 that slidingly fits said device 106 to mount and hold panel 104 a). FIG. 8 illustrates additional device 108 that slidingly fits said device 106 and device 109 that slidingly fits said extrusion 102 a) for holding gadgets and bags. FIG. 9 illustrates device 106 a) to be mounted by way of snapping into extrusion. FIG. 10 illustrates top view of said entrenched channel 101 on desk top surface and said extended extrusion 102. FIG. 11 illustrates perspective top view of said desktop, said entrenched channel and said extended extrusion.

The novel features believed characteristic of the embodiments of the present invention describes a desk whereas one or more extended channel are entrenched routed or carved into and across the top surface, side surface, and bottom surface of the said desk and additionally routed or carved into top surface of the leg units. Whereas metal or plastic extended extrusion are inserted into said routed channel for support. Further, specifically designed devices slidingly fitting said extrusion system will be used to hold books, smartphones, tablets, hooks, plastic panels, and other devices. Said extrusion system will also have the purpose of connecting, join and interlocking two or more desks together by using metal or plastic formed or extruded devices that fit said extrusion system, thus connecting and interlocking said desks. Said extrusion system on the side and bottom surface of the said desk will additionally have the purpose of connecting and interlocking the leg units to the desktop by using said formed or extended extruded devices as described thus allowing easy and fast assembly at location. The present invention describes how said channel, said extrusion said interlocking system, said devices allow for said desk to transform from a normal desk workstation as described in related art into a desk with new utility features thus greatly enhancing the user experience.

What is claimed is:

1. A desk utility system, comprising a desk having:

a top surface area, a bottom surface area, and a side surface, extended extrusions, and leg units;

at least one extended channel entrenched and routed into and across the top surface area of the desk, one of the extended extrusions is inserted into the at least one routed channel for providing support to the at least one routed channel, wherein another extended channel is entrenched and routed into and across the bottom surface area of the desk, wherein another of the extended extrusions is slidingly fitting and secured into said extended entrenched channel of the bottom surface area of the desk;

another extended channel is entrenched and routed into a top surface area of one or more of the leg units wherein another of the extended extrusions is inserted into the routed channel of the leg unit; and one or more devices slidingly fitting and/or snapped into one of said extended extrusions.

2. The desk utility system of claim 1, wherein said devices are made from a group of sturdy materials, the group comprising at least one of aluminum extrusions, cast aluminum, plastic extrusions, or formed or injection molded plastics.

3. The desk utility system of claim 1, wherein said devices are formed or shaped to hold and support contraptions and devices, the support contraptions and devices comprising at least one of books, smart phones, plastics or wood sidings, interlocking devices and other contraptions.

4. The desk utility system of claim 1, wherein said one or more devices are inserted into the one of the extended extrusions on the bottom surface to slidingly join and interlock the leg units to the top surface area and the bottom surface area of the desk.

* * * * *